United States Patent [19]

Longuet-Higgins

[11] Patent Number: 5,009,625

[45] Date of Patent: Apr. 23, 1991

[54] BUILDING BLOCKS

[76] Inventor: Michael S. Longuet-Higgins, 1 Branch Road, Comberton, Cambridge CB3 7DH, England

[21] Appl. No.: 382,799

[22] PCT Filed: Jan. 12, 1988

[86] PCT No.: PCT/GB88/00017

§ 371 Date: Aug. 1, 1989

§ 102(e) Date: Aug. 1, 1989

[87] PCT Pub. No.: WO88/05329

PCT Pub. Date: Jul. 28, 1988

[30] Foreign Application Priority Data

Jan. 13, 1987 [GB] United Kingdom ..... 8700706

[51] Int. Cl.[5] ..... A63H 33/04

[52] U.S. Cl. ..... 446/92; 446/85; 434/211

[58] Field of Search ..... 446/92, 128, 125, 124, 446/153; 434/211, 403, 277, 278

[56] References Cited

U.S. PATENT DOCUMENTS 2,206,149 7/1940 Balinkin ..... 434/277
3,184,882 5/1965 Vega ..... 446/92
3,611,620 10/1971 Perry ..... 446/125 X
3,654,375 4/1972 Geiger ..... 434/403
4,238,905 12/1980 MacGraw, II ..... 446/92

FOREIGN PATENT DOCUMENTS 8400227 8/1985 Netherlands .
1026082 4/1966 United Kingdom .

OTHER PUBLICATIONS

Physical Review B, Condensed Matter, vol. 34, No. 2, 3rd Series, Jul. 15, 1986, American Physical Society, "Quasicrystals, I. Definition and Structure", pp. 596–616, D. Levine et al.

*Primary Examiner*—Mickey Yu
*Attorney, Agent, or Firm*—Andrus, Sceales, Starke & Sawall

[57] ABSTRACT

A set of building blocks having two subsets of rhombohedral blocks (B,Y) having respectively dihedral angles of 72° and 36° so that the faces of both subsets of blocks are identical. Each of the faces incorporates magnets (11) whereby juxtaposed faces of any two blocks will stick together magnetically in a predetermined angular orientation.

13 Claims, 4 Drawing Sheets

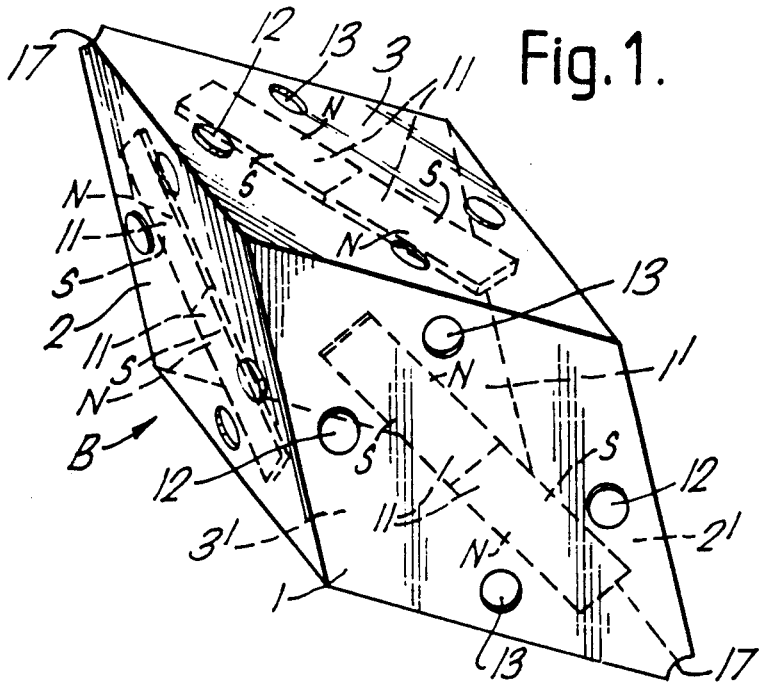
Fig. 1.
Fig. 5.
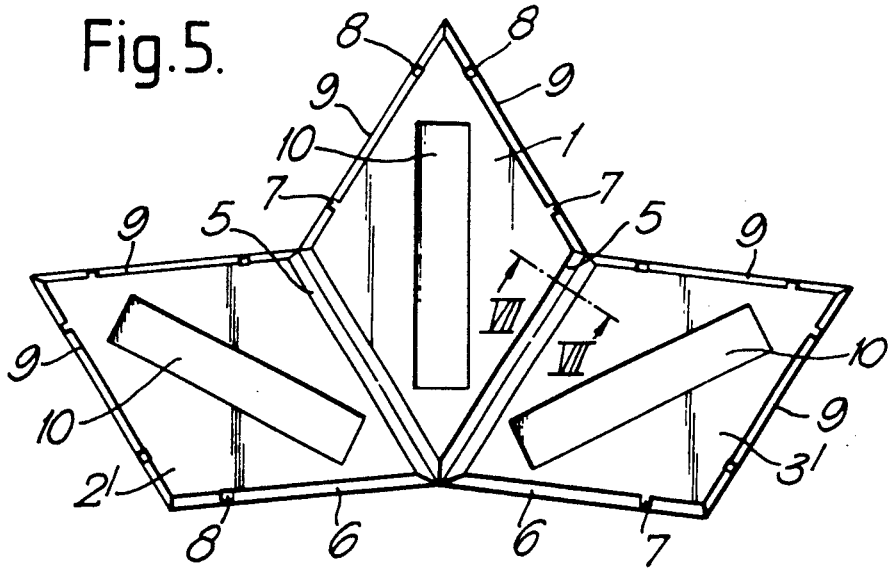
Fig. 7.
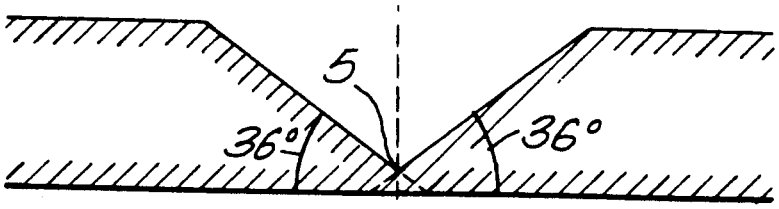

BUILDING BLOCKS

BACKGROUND AND SUMMARY

The present invention relates to a set of building blocks and, in accordance with the invention, the blocks of such a set are constructed so as to be capable of being held together face to face magnetically.

With this arrangement, when blocks are juxtaposed, face on face, three dimensional figures may be produced, the blocks holding onto one another without dependence on gravity.

The blocks are most simply moulded from plastics material, either solid or hollow.

The magnetic attraction may be provided by magnets, such as bar magnets or transversely polarized magnetic strips, let into the faces of the blocks, or moulded or otherwise provided within the blocks, e.g. fitted to inner surfaces of a multipart moulding before assembly, at positions at which they will provide a sufficient and appropriate magnetic field at the faces of the block.

The positions and/or number of magnetic poles provided for each adjacent face of juxtaposed blocks may be such as to cause particular angular alignment of the faces about an axis perpendicular to the faces. Furthermore, if at least one of those faces has rotational symmetry about an axis perpendicular to the face, the magnetic forces may be such that the blocks will tend to rotate to one or other of a plurality of stable positions corresponding to the symmetry of the face. This may be achieved by providing the rotationally symmetrical face with a pair of opposite magnetic poles on each side of each plane containing the axis of symmetry and one of a number of points of symmetry at the edge of the face, whereby when two of the rotationally symmetrical faces of different blocks are juxtaposed face to face the blocks will tend to rotate relatively to one another to one or other of a plurality of stable positions corresponding in number to the symmetry of the faces. There will thus be provided a ring of alternate magnetic poles around the axis of symmetry arranged symmetrically in pairs. Each pair of poles may be provided by the opposite edges of a transversely polarized magnetic strip which will thus extend on or just below the surface in the radial direction outwardly from the axis of symmetry. By way of example, in the case of a face having the shape of a rhombus, each adjacent pair of quadrants, formed by dividing the rhombus by its diagonals, would contain one a north pole and the other a south pole, for example by two strips of transversely polarized magnetic strip extending end to end, but of opposite hand, down the longer diagonal of the face. It will then be appreciated that if two similar faces are brought together, irrespective of whether or not one face is rotated through 180° relatively to the other, the faces will always be attracted to a stable position in which one rhombic face overlies and is in angular alignment with the other.

The or each rotationally symmetrical face may be provided with a complementary spigot and shallow recess symmetrically one on each side of each plane containing the axis of symmetry and one of a number of points of symmetry at the edge of the face, whereby, in each of the stable positions, opposed spigots and recesses mate with one another. Although the spigots and recesses can be a loose fit, so that they do not hold the faces together, they are useful in inhibiting sliding of the faces over one another under gravity.

The set of blocks may consist of or include two subset each of blocks of the same shape but different from those of the other subset, the blocks of a first one of the subsets having faces with a shape and size which are the same as, or an integral multiple of, those of the faces of the blocks of the second subset, whereby a face of one block, or of each of a number of blocks, of the second subset may be juxtaposed with and attracted to one face of a block of the first subset.

The set of blocks provide particular interest if solid three dimensional bodies can be built by close fitting multiple blocks. Cubic and rectangular parallelopiped blocks are trivial examples and greater interest is provided if the blocks involve angles other than 90°, for example subsets of octahedra and tetrahedra. Both the octahedra and tetrahedra may then have edges of common length.

Of greatest interest at the moment is a set of blocks, both subsets of which are formed by rhombohedra, particularly with the blocks of one subset having dihedral angles of 72° (and 108°), and the other having dihedral angles of 36° (and 144°). Each of these two types of rhombohedra will have rhombic faces with an acute angle of 63.43° (the angle whose tangent is 2). In lay terms, each rhombohedron of one subset can be considered to be a cube which has been notionally stretched along a diagonal of the cube, and that of the other subset notionally compressed along the same diagonal. The dihedral angles of 72° and 36° leads to a facinating range of possible interposition of blocks of the two subsets. For example, a possible starting point for a geometric figure involves placing five of the blocks with a dihedral angle of 72° symmetrically around a vertical axis with the edges of the blocks at which the 72° dihedral angle is formed lying parallel to, and immediately adjacent to one another at, the axis. Blocks of both types of subsets can then be close fitted into the recesses formed between the first five blocks. This actually provides a basis, for building a regular triakontahedron, or Keppler's solid, from ten of the blocks of each subset provided all the faces are of the same dimensions.

A set of blocks in accordance with the invention is ideally suited as an educational toy, such as an aid to teaching or for demonstration purposes, involving three dimensional visualization, or as a puzzle. Not only may regular geometric figures, such as quasi-crystals (as defined in Phys. Rev. 1986, Series B, Volume 34, pages 596–616), be produced, but the blocks may also be used to produce irregular figures by way of free expression. Three dimensional figures with particularly attractive patterns of blocks may be created if the blocks are of more than one different color. For example, the blocks of one subset may be of one color and those of the other subset of another color.

Although the blocks may be assembled manually, interesting experiments and demonstrations may be carried out if the blocks are of neutral buoyancy in a common liquid, such as water, a salt solution, an oil, or an alcohol, having a specific gravity of between, e.g. 0.5 and 1.5, particularly between 0.8 and 1.1, and, for use in water, 1.0. In that event, in a bath of the liquid, the blocks will automatically and naturally coalesce, owing to the domination of the magnetic forces over gravitational forces, to produce interesting figures. The neutral buoyancy may be provided by making the blocks of a plastics material, such as a foamed plastics material, having a specific gravity less that of the liquid in which the blocks are to be immersed, e.g. in the range of 0.8–0.9 if the liquid is water. The magnetic sources will normally have a specific gravity greater than that of the liquid and the masses of plastics and magnetic materials will be selected so that the overall specific gravity of the blocks is as required, i.e. substantially 1.0 if the liquid is water. A useful development of this principle is obtained if the blocks are suspended in a liquid, such as a variable salt solution, having a vertical density gradient. The blocks will then settle and float substantially at a level corresponding to their own mean density, when the blocks are moulded from a plastics material, they are preferably hollow, rather than solid, as this uses less material and is therefore cheaper and involves less dimensional inaccuracy caused by shrinkage. However, if the hollow interior of a block is sealed and full of air, the mean density of the block is likely to be much less than that of a common liquid. The sealed interior of the block could be filled with a liquid but this would involved potential leakage when the block is not immersed. Preferably therefore, each of the blocks is hollow, and the wall of the block is provided with one or more holes to allow the block to fill with liquid in which it is immersed.

It is not essential for all the faces of all the blocks to attract one another and some may be arranged to repel one another magnetically, or to be quite neutral magnetically, whereby a selection is necessary to achieve an attraction between the adjacent faces of juxtaposed blocks.

BRIEF DESCRIPTION OF THE DRAWINGS

A set of blocks constructed in accordance with the invention and consisting of two subsets of rhombohedral blocks with dihedral angles of 72° and 36° are illustrated in the accompanying drawings; in which:

FIGS. 1 and 2 are perspective views of one block of each of the first and second subset, respectively;

FIGS. 5 and 6 are plans of first and second plastics mouldings from which the FIGS. 1 and 2 blocks, respectively, are assembled;

FIGS. 7 are 8 are sections taken on the lines VII—VII in FIG. 5, and VIII—VIII in FIG. 6, respectively; and, FIGS. 9 and 10 are perspective views of solid figures which can be assembled from the blocks.

DETAILED DESCRIPTION OF THE PREFERRED EMBODIMENT

The FIG. 1 block B, which may be blue, is hollow and rhombohedral, having three pairs of parallel walls 1, 1'; 2, 2'; and 3, 3'. Each of the outer faces of the walls is of identical rhombic shape and size, with edges each 5 cm long. The dihedral angles at the edges between the outer faces of the walls 1 and 2'; 1 and 3'; 2' and 3'; 2 and 3; 2 and 1'; and 3 and 1', are each 72°, and the dihedral angles at the other six edges are 108°. Consequently each of the rhombic faces has an acute angle of 63.45.20

Figure 2:
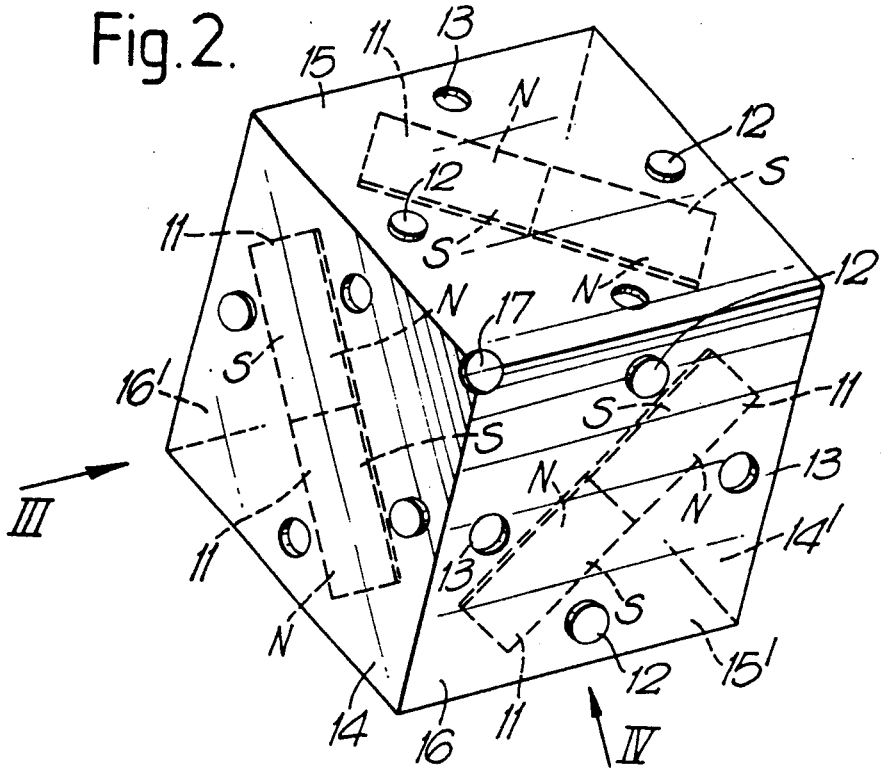
Figure 3:
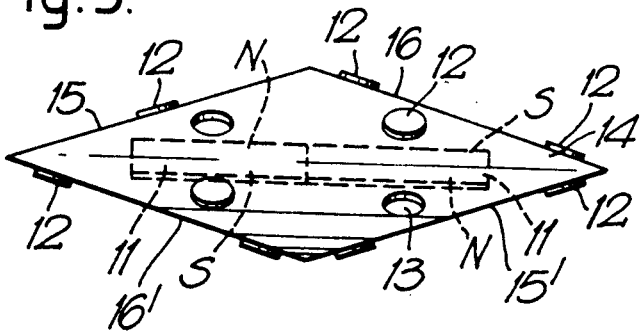
FIGS. 3 and 4 are elevations as seen on the arrows III and IV in FIG. 2.
Figure 4:
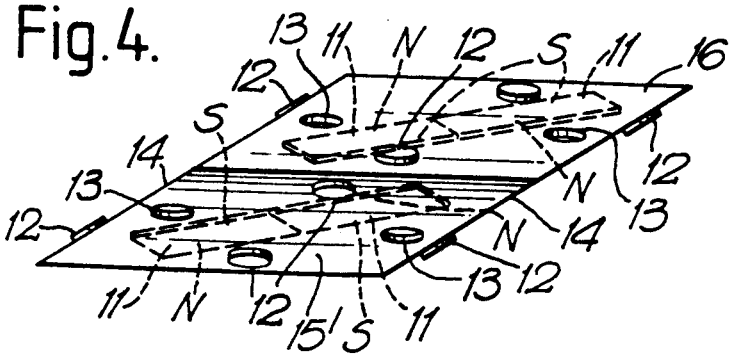

The block is formed from two thin plastics mouldings of a suitable material, particularly a plastics material, such as foamed polystyrene, as shown in FIG. 3. This shows the inner surfaces of the walls 2', 1, 1', which are integrally moulded and interconnected by two film hinges 5. The hinges are chamfered as shown in FIG. 7 to provide the appropriate dihedral angles of 72°, when as a preliminary assembly step, the walls 2', 3' are folded up about the hinges in FIG. 7 and bonded together at their then abutting edges 6. These edges are also chamfered to provide the appropriate dihedral angle of 72° and are provided with one a pimple 7 and the other a dimple 8 to provide location during the bonding. The resulting unit, which may be likened in shape to an angular tulip flower with three pointed petals, is then bonded to a similar unit providing the walls 1', 2, 3 so that the six edges g of one unit mate with and are bonded to the complementary edges g of the other unit, again with the help of pimples 7 and dimples 8 for location purposes, to provide the dihedral angles of 108°. These edges 9 are chamfered accordingly to produce these dihedral angles.

The inner surface of each of the walls is provided with a rectangular recess 10 aligned with the longer diagonal of the rhombus. Before the blank is folded two transversally polarized strips 11 of opposite hand are bonded end to end in each of the recesses 10 to provide magnetic poles as shown in FIG. 1. The strips are post-magnetized extruded plastics strips incorporating ferrite magnetic powder. The effect of this is that when any two faces of any two of the blocks B are juxtaposed, they will hold together face to face in either of the two positions in which they exactly overlap one another with the same angular orientation, and with the two north poles of each face as close as possible to respective ones of the two south poles of the other face.

Unless the magnets are very strong, there will be a slight tendency for blocks to slide face to face over one another and to preclude this, symmetrically arranged pairs of projections 12 and recesses 13 are provided on each of the faces. In each of the juxtaposed aligned positions, the projections 12 of one face will enter the recesses 13 of the other face.

The blocks Y, which may be yellow, each consist of three pairs of parallel walls 14, 14'; 15, 15'; and 16, 16'. The dihedral angle at each of the six edges between the outer faces of the walls 14 and 15;, 14 and 16; 15 and 16; 14' and 15'; 15' and 16'; and 16' and 14' is 144° whereas the dihedral angles of the other six edges are each 36°. As a result each of the faces of a block Y is identical in shape and size to each of the faces of a block B.

Figure 6:
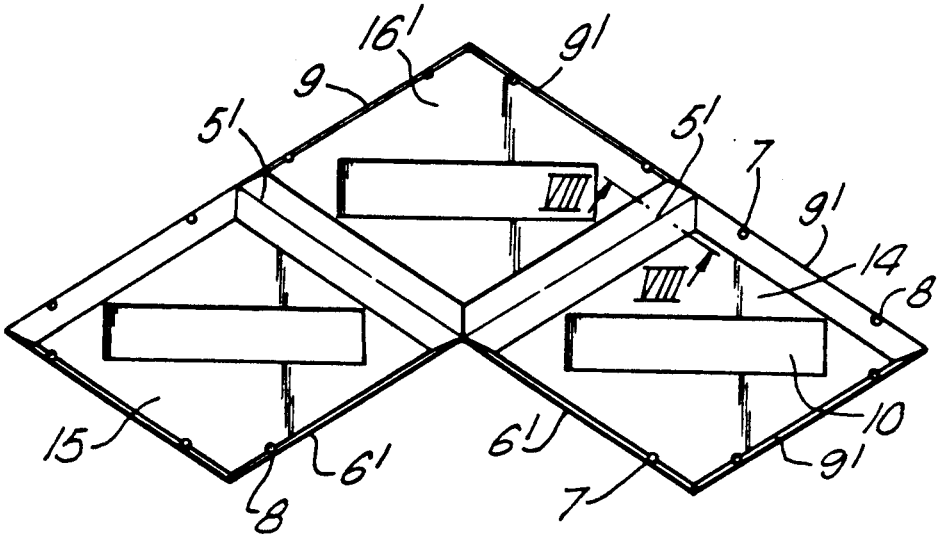
Figure 8:
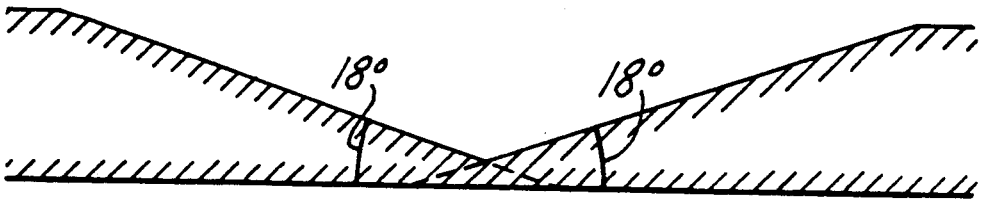

Each block Y is constructed analogously to the previously described construction of a block B, but from two blanks as shown in FIGS. 6 and 8, the film hinges 5' and edges 6' and 9' being chamfered accordingly to produce to the required dihedral angles. It follows that any of the faces of a block B or of a block Y will hold together magnetically, with the assistance of the spigots and recesses 12, 13 so that the blocks of both subsets may be built together as required to provide different resulting shapes.

The blocks, when to be neutrally buoyant in a liquid, such as water, will be provided with, for example two oppositely positioned, holes 17, to allow the blocks to fill with the liquid when immersed.

Figure 9:
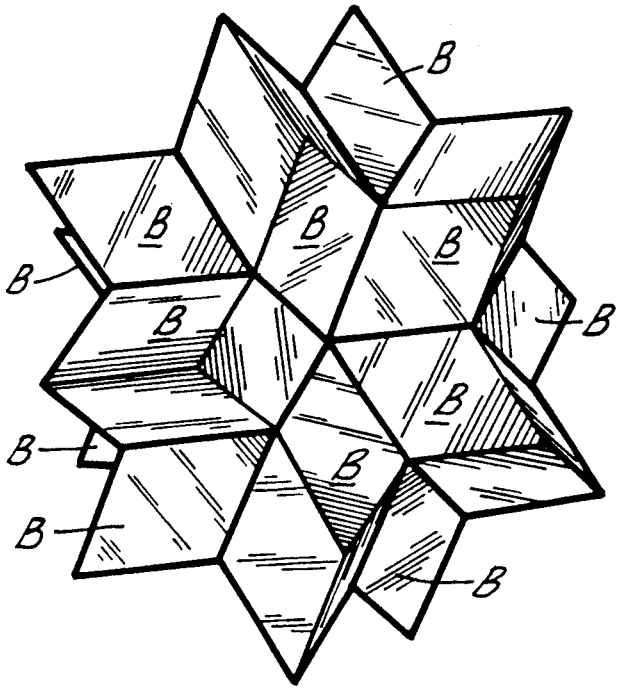
Figure 10:
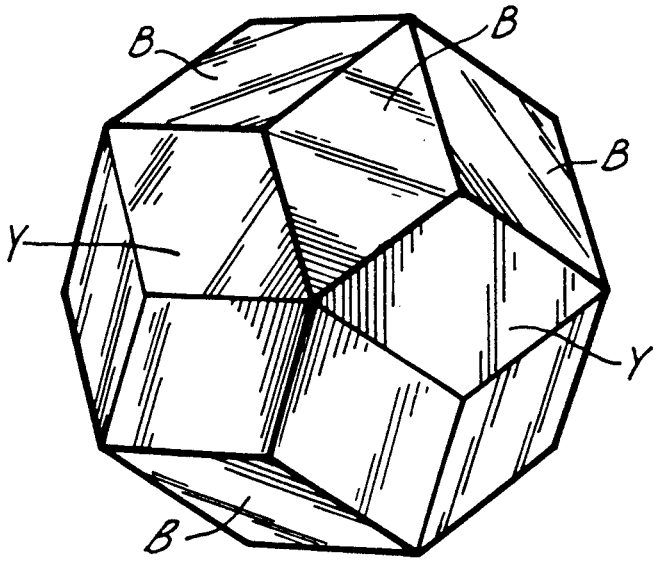

FIG. 9 shows one construction which may be created from a number of the blocks B, whereas FIG. 10 shows a regular triakontahedron which may be created from a combination of the blocks of both kinds and Y.

I claim:

1. A set of building blocks which are constructed so as to be capable of being held together face to face magnetically; wherein said set includes two subsets each of blocks of the same shape but different from those of the other subset, both subsets being formed by rhombohedra having a plurality of faces, with the blocks of one subset having dihedral angles of 72° (and 108°), and the blocks of the other subset having dihedral angles of 36° (and 144°), all the faces of all said blocks having the same dimensions, and wherein each face of each block is provided with a pair of opposite magnetic poles on each side of a long diagonal of said face by opposite edges of a pair of transversely polarized magnetic strips extending along said diagonal of each said face, said strip covering an area less than the surface area of said face, whereby when two faces of different ones of said blocks are juxtaposed face to face said blocks will tend to rotate relatively to one another to one of two stable positions in which said faces are aligned.

2. A set according to claim 1, in which each of said blocks is hollow and the magnetic strips are located in complementary recesses in the inner wall surfaces of said block.

3. A set according to claim 1, in which each said face is provided with a complementary spigot and shallow recess symmetrically one on each side of each said diagonal, whereby, in each of said stable positions, opposed spigots and recesses mate with one another.

4. A set according to claim 1, wherein said blocks of one subset are of one color and those of the other subset of a different color.

5. A set according to claim 1, including two subsets each of blocks of the same shape but different from those of the other subset, said blocks of one of said subsets having faces with a shape and size which are the same as, or an integral multiple of, those of the faces of said blocks of the other subset, whereby a face of one of said blocks, or of each of a number of said blocks, of said other subset may be juxtaposed with and attracted to one face of a block of said one subset.

6. A set of building blocks which are constructed so as to be capable of being held together face to face magnetically; wherein said set includes two subsets each of blocks of the same shape but different from those of the other subset, both subsets being formed by rhombohedra, with the blocks of one subset having dihedral angles of 72° (and 180°), and the blocks of the other subset having dihedral angles of 36° (and 144°), all the faces of all said blocks having the same dimensions, in which the average specific gravity of said blocks is such that they are neutrally buoyant in a liquid having a specific gravity of between 0.5 and 1.5.

7. A set according to claim 6, in which the average specific gravity of said blocks is substantially 1.0.

8. A set according to claim 6, wherein each of said blocks is hollow and each said block is provided with one or more holes to allow each said block to fill with liquid in which it is immersed.

9. A set of building blocks which are constructed so as to be capable of being held together face to face magnetically, wherein the average specific gravity of said blocks is such that they are neutrally buoyant in a liquid having a specific gravity of between 0.5 and 1.5.

10. A set according to clam 9, in which at least one face of each said block has rotational symmetry about an axis perpendicular to said face, said rotationally symmetrical face being provided with a pair of opposite magnetic poles on each side of each plane containing said axis of symmetry and one of a number of points of symmetry at the edge of said face, whereby when two of said rotationally symmetrical faces of different ones of said blocks are juxtaposed face to face said blocks will tend to rotate relatively to one another to one or other of a plurality of stable positions corresponding in number to the symmetry of said faces.

11. A set according to claim 10, in which each pair of said poles are provided by opposite edges of a pair of transversely polarized magnetic strips extending in the radial direction outwardly from said axis of symmetry.

12. A set according to claim 11, in which each of said blocks is hollow and said magnetic strips are located in complementary recesses in the inner wall surfaces of said block.

13. A set according to claim 10, in which each said rotationally symmetrical face is provided with a complementary spigot and shallow recess symmetrically one on each side of each plane containing said axis of symmetry and one of a number of points of symmetry at the edge of said face, whereby, in each of said stable positions, opposed ones of said spigots and recesses mate with one another.

* * * * *